US012736232B2

(12) United States Patent
Sakamaki et al.

(10) Patent No.: US 12,736,232 B2
(45) Date of Patent: Sep. 15, 2026

(54) AIR CONDITIONER CONSTITUENT UNIT AND AIR CONDITIONER

(71) Applicant: DAIKIN INDUSTRIES, LTD., Osaka (JP)

(72) Inventors: Tomohiko Sakamaki, Osaka (JP); Akira Omiya, Osaka (JP); Tsuyoshi Kimura, Osaka (JP); Naonobu Miyatani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 100 days.

(21) Appl. No.: 18/982,606

(22) Filed: Dec. 16, 2024

(65) Prior Publication Data

US 2025/0116414 A1 Apr. 10, 2025

Related U.S. Application Data

(63) Continuation of application No. PCT/JP2023/028980, filed on Aug. 8, 2023.

(30) Foreign Application Priority Data

Sep. 27, 2022 (JP) ..... 2022-153767

(51) Int. Cl.
*F24F 1/0326* (2019.01)
*F24F 1/0068* (2019.01)
(Continued)

(52) U.S. Cl.
CPC ..... *F24F 1/0326* (2019.02); *F24F 1/0068* (2019.02); *F28F 9/0256* (2013.01); *F28F 17/005* (2013.01); *F28F 21/08* (2013.01)

(58) Field of Classification Search
CPC ..... F24F 1/0326; F24F 1/0068; F28F 9/0256; F28F 9/0275; F28F 17/005; F28F 19/00; F28F 21/08
See application file for complete search history.

(56) References Cited

U.S. PATENT DOCUMENTS

2021/0231343 A1* 7/2021 Matsumoto ..... F24F 1/0068
2022/0243952 A1 8/2022 Kojima

FOREIGN PATENT DOCUMENTS

CN 113544441 A 10/2021
JP 5853203 B2 2/2016
(Continued)

OTHER PUBLICATIONS

English translation of the International Preliminary Report on Patentability and Written Opinion of the International Searching Authority for International Application No. PCT/JP2023/028980, dated Apr. 10, 2025.

(Continued)

*Primary Examiner* — Joseph F Trpisovsky
(74) *Attorney, Agent, or Firm* — Birch, Stewart, Kolasch & Birch, LLP

(57) ABSTRACT

A refrigerant pipe connected to a flow divider includes a first pipe made of aluminum or aluminum alloy, and a second pipe made of copper or copper alloy. A first connection end of the first pipe and a second connection end of the second pipe are connected. A cover member is disposed in a through hole to extend across an internal space and an external space of a casing, A first portion of the refrigerant pipe including the first connection end of the first pipe and the second connection end of the second pipe is covered with the cover member.

13 Claims, 9 Drawing Sheets

(51) Int. Cl.

| | |
|---|---|
| *F28F 9/02* | (2006.01) |
| *F28F 17/00* | (2006.01) |
| *F28F 21/08* | (2006.01) |

(56) References Cited

FOREIGN PATENT DOCUMENTS

| | | | | | |
|---|---|---|---|---|---|
| JP | 2020190381 | A | * | 11/2020 | |
| WO | WO-2013084433 | A1 | * | 6/2013 | ..... F28F 19/004 |
| WO | WO-2022107220 | A1 | * | 5/2022 | ..... F24F 11/36 |

OTHER PUBLICATIONS

International Search Report (PCT/ISA/210) issued in PCT/JP2023/028980, dated Oct. 10, 2023.

Extended European Search Report for European Application No. 23871496.8, dated Jun. 16, 2025.

* cited by examiner

AIR CONDITIONER CONSTITUENT UNIT AND AIR CONDITIONER

CROSS REFERENCE TO RELATED APPLICATIONS

This application is a Continuation of PCT International Application No. PCT/JP2023/028980, filed on Aug. 8, 2023, which claims priority under 35 U.S.C. 119 (a) to Patent Application No. 2022-153767, filed in Japan on Sep. 27, 2022, all of which are hereby expressly incorporated by reference into the present application.

TECHNICAL FIELD

The present disclosure relates to a constituent unit forming an air conditioner, and an air conditioner.

BACKGROUND ART

In a constituent unit forming an air conditioner, a portion (aluminum pipe portion) made of aluminum or aluminum alloy and a portion (copper pipe portion) made of copper or copper alloy may be mixed in a pipe through which refrigerant flows. Aluminum has a higher ionization tendency than that of copper. For this reason, when condensate water generated on the surface of the copper pipe portion and containing copper ions adheres to the aluminum pipe portion, the aluminum pipe portion may be corroded.

Japanese Patent No. 5853203 (particularly, see FIG. 2) discloses the following: In order to solve the above-described problem, a U-shaped or inverted U-shaped pipe is provided between an aluminum heat transfer tube and a copper pipe in a heat exchanger. In this structure, condensate water generated on the surface of the copper pipe is blocked by the U-shaped or inverted U-shaped pipe, and cannot reach the aluminum heat transfer tube.

SUMMARY

A first aspect is directed to a constituent unit of an air conditioner. The constituent unit includes a casing having a through hole, a heat exchanger that is housed in the casing and has a plurality of heat transfer tubes, a refrigerant pipe passing through the through hole, a flow divider that is connected to the heat exchanger and the refrigerant pipe and distributes refrigerant flowing in from the refrigerant pipe to the plurality of heat transfer tubes, and a cover member covering the refrigerant pipe. The refrigerant pipe has a first pipe connected to the flow divider and made of aluminum or aluminum alloy, and a second pipe made of copper or copper alloy. A first connection end of the first pipe and a second connection end of the second pipe are directly connected or connected through a metal pipe made of a material different from those of the first pipe and the second pipe. The cover member is disposed in the through hole so as to extend across an internal space and an external space of the casing, and a first portion of the refrigerant pipe including the first connection end of the first pipe and the second connection end of the second pipe is covered with the cover member.

BRIEF DESCRIPTION OF THE DRAWINGS

FIG. 4 is a schematic sectional view of the indoor unit taken along line IV-O-IV in

FIG. 3.

DESCRIPTION OF EMBODIMENTS

Embodiments of the present disclosure will be described in detail below with reference to the drawings. The present disclosure is not limited to the embodiments shown below, and various changes can be made within the scope without departing from the technical concept of the present disclosure. Each of the drawings is intended to illustrate the present disclosure conceptually, and dimensions, ratios, or numbers may be exaggerated or simplified as necessary for the sake of ease of understanding.

EMBODIMENTS

An air conditioner (10) of an embodiment will be described.

—Air Conditioner—

Figure 1:
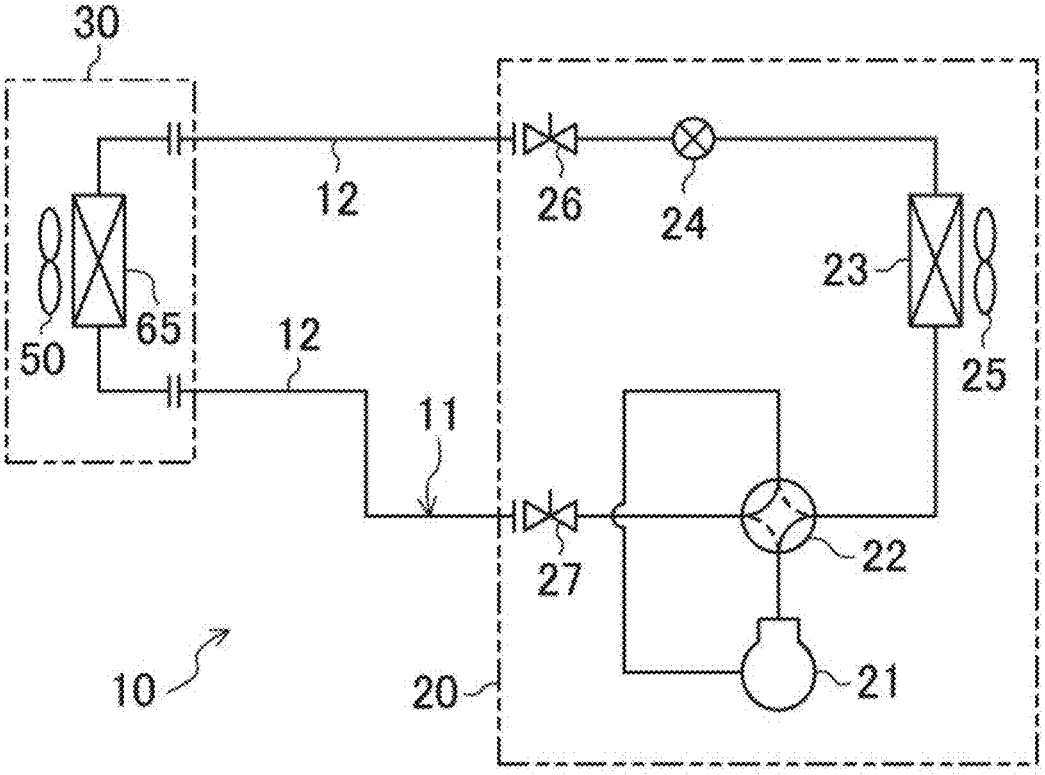
FIG. 1 is a piping system diagram illustrating an air conditioner of an embodiment.

As illustrated in FIG. 1, the air conditioner (10) includes an outdoor unit (20) and an indoor unit (30). Each of the outdoor unit (20) and the indoor unit (30) is a constituent unit forming the air conditioner (10).

The outdoor unit (20) and the indoor unit (30) are connected to each other through a pair of connection pipes (12). In the air conditioner (10), the outdoor unit (20), the indoor unit (30), and the connection pipes (12) form a refrigerant circuit (11) that performs a vapor compression refrigeration cycle.

<Outdoor Unit>

The outdoor unit (20) is installed outdoors. The outdoor unit (20) has a compressor (21), a four-way switching valve (22), an outdoor heat exchanger (23), an outdoor fan (25), an expansion valve (24), a liquid-side shutoff valve (26), and a gas-side shutoff valve (27).

The compressor (21) is, for example, a hermetic scroll or rotary compressor. The compressor (21) sucks and compresses low-pressure refrigerant, and discharges the refrigerant (high-pressure refrigerant) compressed into a high pressure.

The four-way switching valve (22) is a valve for changing the flow of refrigerant in the refrigerant circuit (11). The four-way switching valve (22) switches between a first state indicated by solid lines in FIG. 1 and a second state indicated by broken lines in FIG. 1. In the first state, the high-pressure refrigerant discharged from the compressor (21) is sent to the outdoor heat exchanger (23), and low-pressure refrigerant flowing in from the indoor unit (30) is sent to the compressor (21). In the second state, the high-pressure refrigerant discharged from the compressor (21) is sent to the indoor unit (30), and low-pressure refrigerant having passed through the outdoor heat exchanger (23) is sent to the compressor (21).

The outdoor heat exchanger (23) is a heat exchanger that allows heat exchange between refrigerant and outdoor air. The outdoor heat exchanger (23) is, for example, a fin-and-tube heat exchanger. The outdoor fan (25) is a fan for supplying the outdoor air to the outdoor heat exchanger (23). The expansion valve (24) is an electric expansion valve having a variable opening degree.

<Indoor Unit>

The indoor unit (30) is installed in an indoor space which is a space to be air-conditioned. The indoor unit (30) has an indoor heat exchanger (65) and an indoor fan (50). The indoor unit (30) will be described in detail later.

<Operation>

The air conditioner (10) selectively performs a cooling operation and a heating operation.

In the cooling operation, the four-way switching valve (22) is set to the first state, and refrigerant circulates through the refrigerant circuit (11). In the refrigerant circuit (11), the outdoor heat exchanger (23) functions as a radiator, and the indoor heat exchanger (65) functions as an evaporator. The indoor unit (30) cools air sucked from the indoor space in the indoor heat exchanger (65), and discharges the cooled air into the indoor space.

In the heating operation, the four-way switching valve (22) is set to the second state, and refrigerant circulates through the refrigerant circuit (11). In the refrigerant circuit (11), the indoor heat exchanger (65) functions as a radiator, and the outdoor heat exchanger (23) functions as an evaporator. The indoor unit (30) heats air sucked from the indoor space in the indoor heat exchanger (65), and discharges the heated air into the indoor space.

—Configuration of Indoor Unit—

Figure 2:
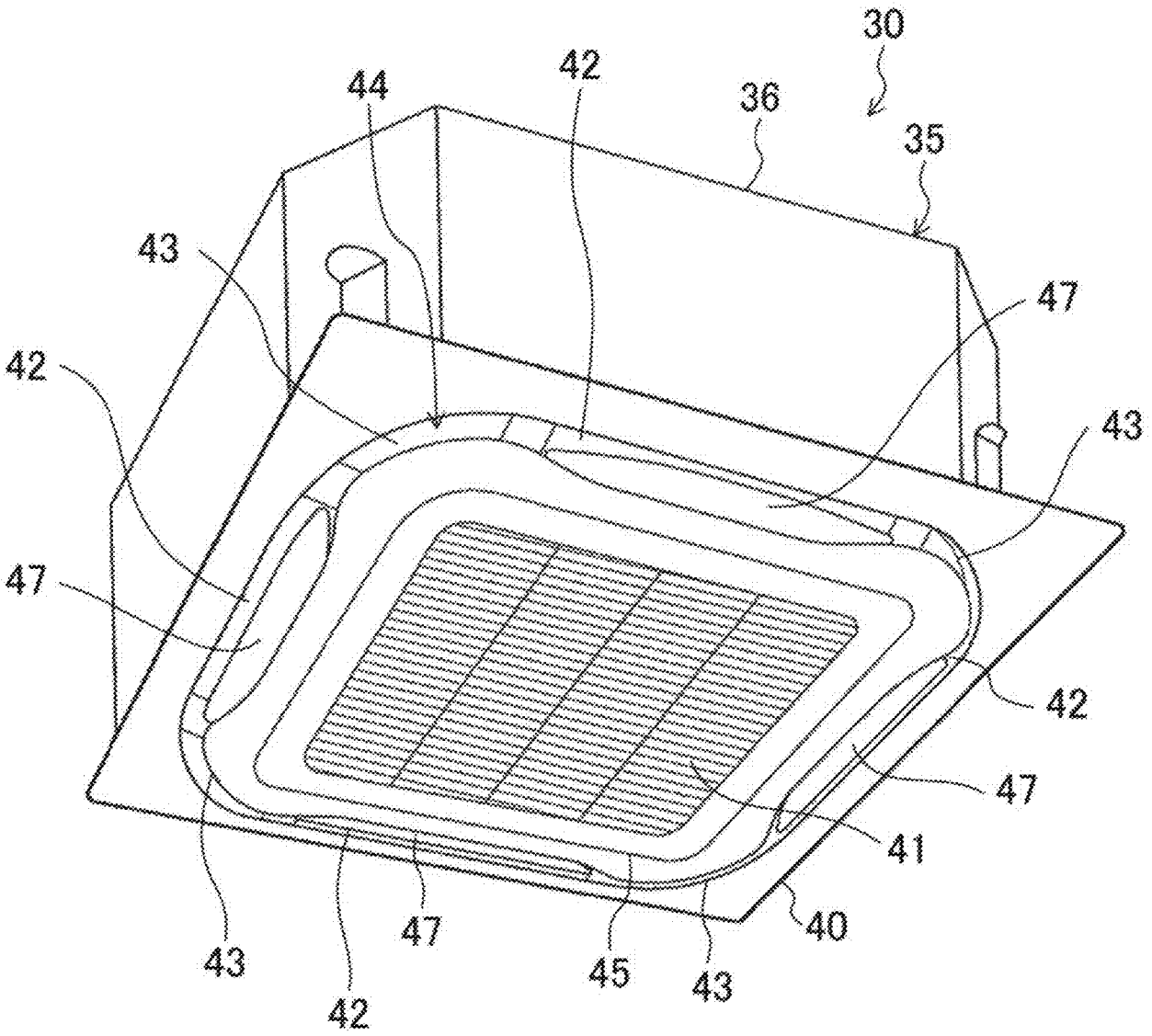
FIG. 2 is a perspective view of an indoor unit as viewed obliquely from below.
Figure 3:
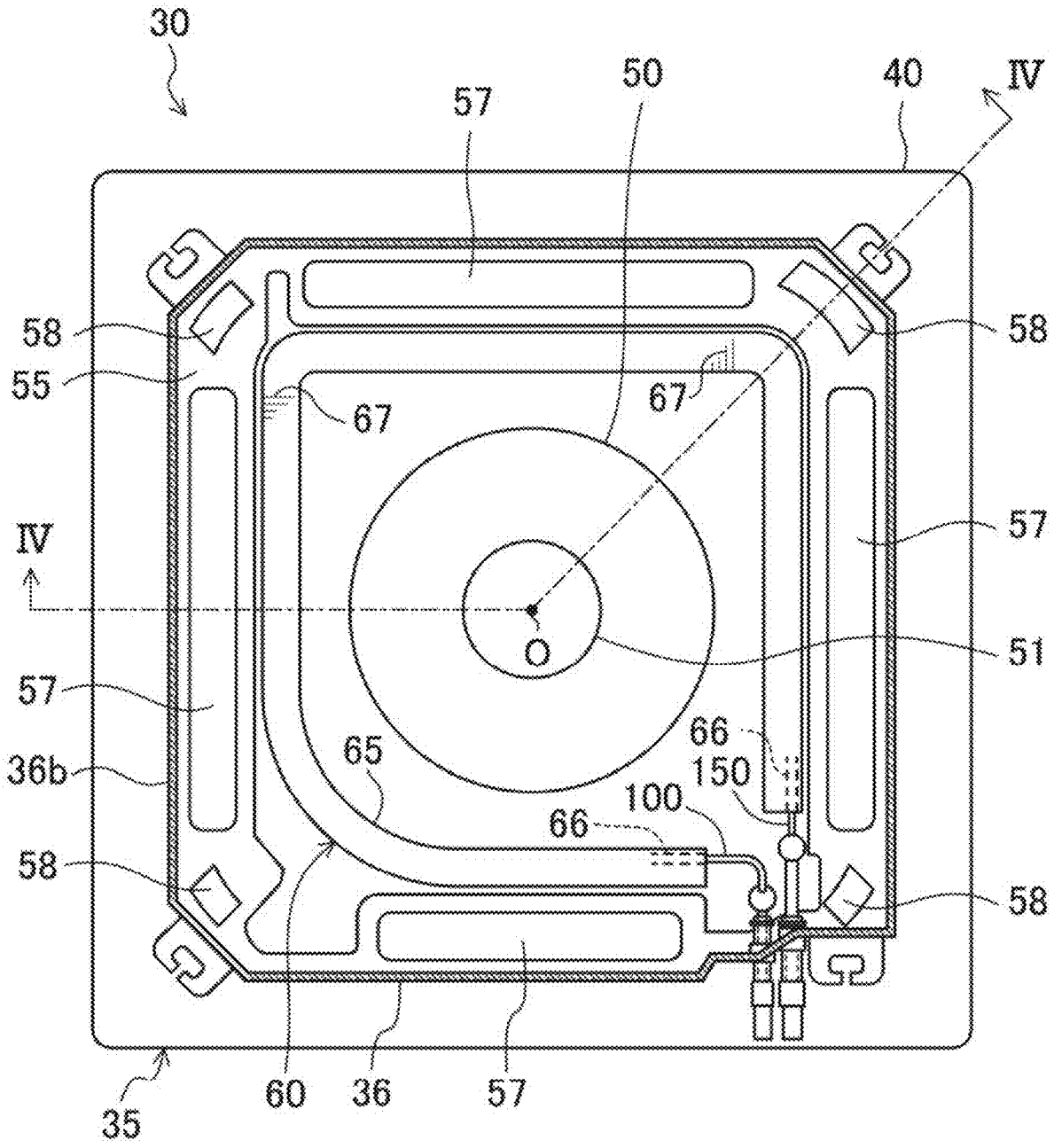
FIG. 3 is a schematic plan view of the indoor unit with a top panel of a casing body omitted.
Figure 4:
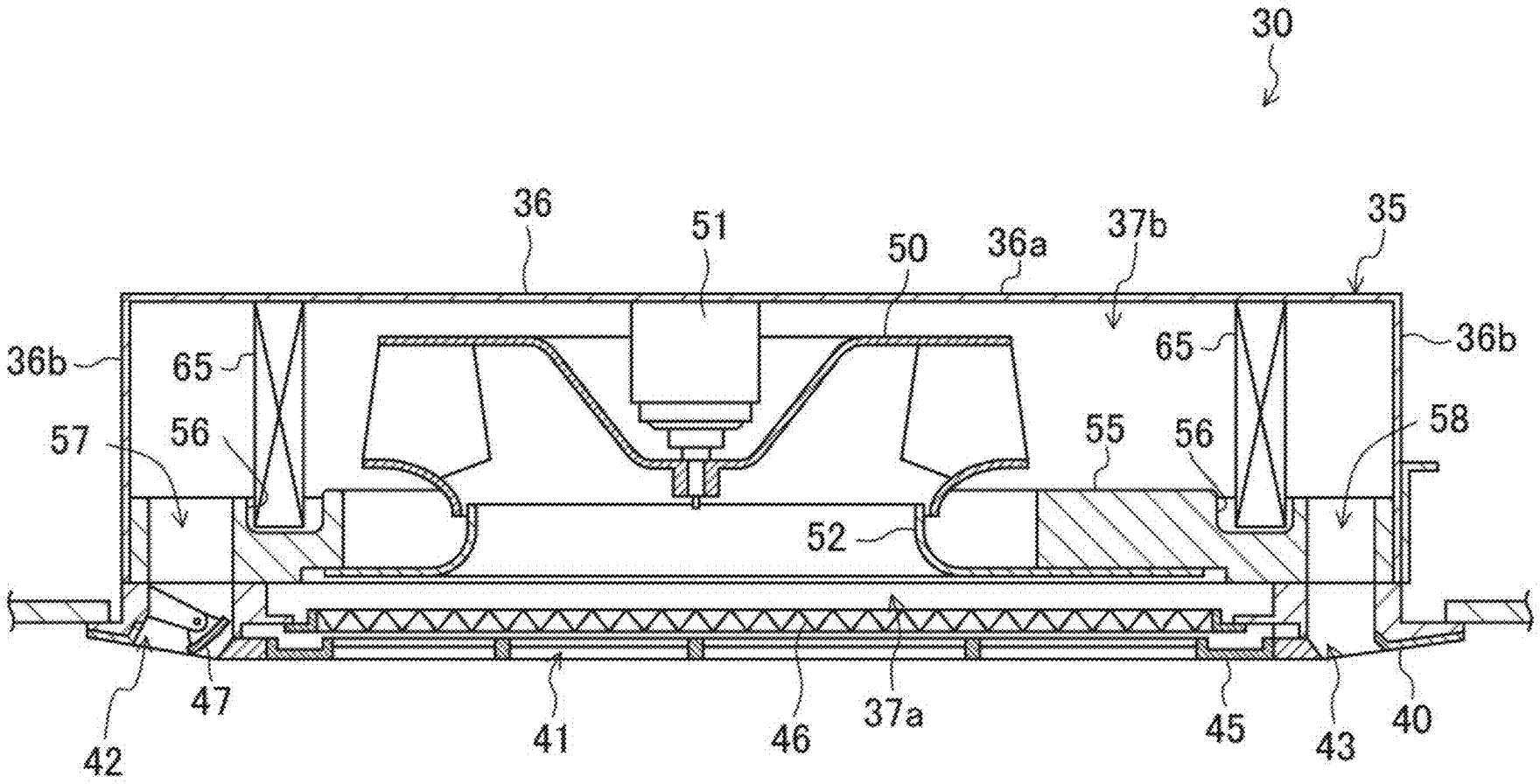

As illustrated in FIG. 2, the indoor unit (30) of this embodiment is a ceiling mounted indoor unit. As illustrated in FIGS. 3 and 4, the indoor unit (30) includes a casing (35), the indoor fan (50), the indoor heat exchanger (65), a drain pan (55), and a bell mouth (52).

A liquid pipe unit (100) and a gas pipe unit (150) are joined to the indoor heat exchanger (65). The indoor heat exchanger (65), the liquid pipe unit (100), and the gas pipe unit (150) form a heat exchanger assembly (60).

<Casing>

The casing (35) includes a casing body (36) and a decorative panel (40). The casing (35) houses the indoor fan (50), the indoor heat exchanger (65), the drain pan (55), and the bell mouth (52).

The casing body (36) is a member having a generally rectangular parallelepiped box-like shape with its lower end open. The casing body (36) has a generally flat plate-shaped top panel (36*a*), and a side panel (36*b*) extending downward from a peripheral portion of the top panel (36*a*). The decorative panel (40) will be described later.

<Indoor Fan>

As illustrated in FIG. 4, the indoor fan (50) is a so-called turbo fan. The indoor fan (50) discharges air sucked from below outward in a radial direction. The indoor fan (50) is disposed at the center in the casing body (36). An indoor fan motor (51) drives the indoor fan (50). The indoor fan motor (51) is fixed to a center portion of the top panel (36*a*).

<Bell Mouth>

The bell mouth (52) is disposed below the indoor fan (50). The bell mouth (52) is a member for guiding air flowing in the casing (35) to the indoor fan (50). The bell mouth (52) and the drain pan (55) divide the internal space of the casing (35) into a primary space (37*a*) located on the inlet side of the indoor fan (50) and a secondary space (37*b*) located on the outlet side of the indoor fan (50).

<Indoor Heat Exchanger>

The indoor heat exchanger (65) is a so-called cross-fin-type fin-and-tube heat exchanger. As illustrated in FIG. 3, the indoor heat exchanger (65) is formed in a rectangular tubular shape, and is disposed so as to surround the indoor fan (50). The indoor heat exchanger (65) is disposed in the secondary space (37*b*). The indoor heat exchanger (65) allows air passing therethrough from the inside to the outside to exchange heat with refrigerant in the refrigerant circuit.

<Drain Pan>

The drain pan (55) is a member made of so-called Styrofoam. As illustrated in FIG. 4, the drain pan (55) is disposed to close the lower end of the casing body (36). The drain pan (55) has an upper surface provided with a water receiving groove (56) extending along the lower end of the indoor heat exchanger (65). A lower end portion of the indoor heat exchanger (65) is inserted in the water receiving groove (56). The water receiving groove (56) receives drain water generated in the indoor heat exchanger (65).

As illustrated in FIG. 3, the drain pan (55) is provided with four main outlet paths (57) and four auxiliary outlet paths (58). The main outlet path (57) and the auxiliary outlet path (58) are paths through which air having passed through the indoor heat exchanger (65) flows, and penetrate the drain pan (55) in an up-down direction.

The main outlet path (57) is a through hole having an elongated rectangular cross section. The main outlet paths (57) are arranged along the four sides of the casing body (36), respectively. The auxiliary outlet path (58) is a through hole having a slightly-curved rectangular cross section. The auxiliary outlet paths (58) are arranged at the four corners of the casing body (36), respectively.

<Decorative Panel>

The decorative panel (40) is a resin member formed in a thick rectangular plate shape. A lower portion of the decorative panel (40) is in a square shape slightly larger than the top panel (36*a*) of the casing body (36). The decorative panel (40) is disposed to cover the lower end of the casing body (36). The lower surface of the decorative panel (40) is exposed to the indoor space.

As illustrated in FIGS. 2 and 4, the decorative panel (40) includes a center portion having a square inlet (41). The inlet (41) penetrates the decorative panel (40) in the up-down direction, and communicates with the primary space (37*a*) in the casing (35). The inlet (41) is provided with a grid-like intake grille (45). A filter (46) is disposed above the intake grille (45).

The decorative panel (40) includes a substantially rectangular annular outlet (44) surrounding the inlet (41). As illustrated in FIG. 2, the outlet (44) is divided into four main outlet openings (42) and four auxiliary outlet openings (43).

The main outlet opening (42) is an elongated rectangular opening. The main outlet openings (42) are arranged along the four sides of the decorative panel (40), respectively. The main outlet openings (42) of the decorative panel (40) correspond to the main outlet paths (57) of the drain pan (55) on a one-on-one basis. Each main outlet opening (42) communicates with a corresponding one of the main outlet paths (57). Each main outlet opening (42) is provided with an airflow direction adjusting flap (47).

The auxiliary outlet opening (43) is an opening in the shape of a quarter of a circle. The auxiliary outlet openings (43) are arranged at the four corners of the decorative panel (40), respectively. The auxiliary outlet openings (43) of the decorative panel (40) correspond to the auxiliary outlet paths (58) of the drain pan (55) on a one-on-one basis. Each auxiliary outlet opening (43) communicates with a corresponding one of the auxiliary outlet paths (58).

<Liquid Pipe Unit>

Figure 5:
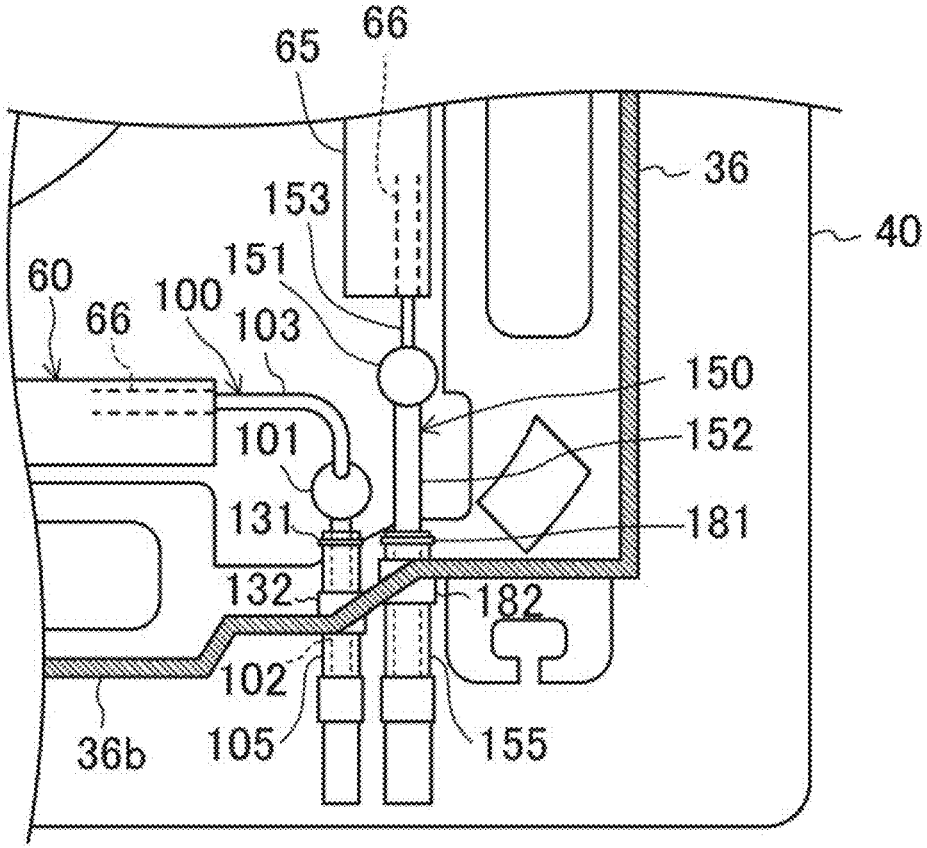
FIG. 5 is an enlarged view of a main part of FIG. 3.

As illustrated in FIG. 5, the liquid pipe unit (100) includes one liquid-side flow divider (101), one liquid-side collecting pipe (102), and a plurality of liquid-side branch pipes (103). FIG. 5 shows only one liquid-side branch pipe (103).

One end of the liquid-side collecting pipe (102) and one end of each liquid-side branch pipe (103) are connected to the liquid-side flow divider (101). The liquid-side flow divider (101) is a member that distributes refrigerant flowing in from the liquid-side collecting pipe (102) to the plurality of liquid-side branch pipes (103).

The other end of each liquid-side branch pipe (103) is connected to a heat transfer tube (66) of the corresponding indoor heat exchanger (65). The liquid-side branch pipe (103) allows the liquid-side flow divider (101) to communicate with the heat transfer tube (66) of the indoor heat exchanger (65).

The liquid-side collecting pipe (102) extends to the outside of the casing body (36) through a first through hole (38*a*) formed in the side panel (36*b*) of the casing body (36). The other end of the liquid-side collecting pipe (102) is exposed to the outside of the casing body (36). The first through hole (38*a*) corresponds to a through hole of the present disclosure.

A liquid-side cover member (105) is attached to the liquid-side collecting pipe (102). The liquid-side cover member (105) is a cylindrical member made of foamed resin. The liquid-side cover member (105) covers a portion of the liquid-side collecting pipe (102) extending from the inside to the outside of the casing body (36), and closes a clearance between an edge portion of the through hole formed in the side panel (36*b*) and the liquid-side collecting pipe (102).

<Gas Pipe Unit>

As illustrated in FIG. 5, the gas pipe unit (150) includes one gas-side flow divider (151), one gas-side collecting pipe (152), and a plurality of gas-side branch pipes (153). FIG. 5 shows only one gas-side branch pipe (153).

One end of the gas-side collecting pipe (152) and one end of each gas-side branch pipe (153) are connected to the gas-side flow divider (151). The gas-side flow divider (151) is a member that distributes refrigerant flowing in from the gas-side collecting pipe (152) to the plurality of gas-side branch pipes (153). The gas-side flow divider (151) is a so-called gas header.

The other end of each gas-side branch pipe (153) is connected to the heat transfer tube (66) of the corresponding indoor heat exchanger (65). The gas-side branch pipe (153) allows the gas-side flow divider (151) to communicate with the heat transfer tube (66) of the indoor heat exchanger (65).

The gas-side collecting pipe (152) extends to the outside of the casing body (36) through a second through hole (38*b*) formed in the side panel (36*b*) of the casing body (36). The other end of the gas-side collecting pipe (152) is exposed to the outside of the casing body (36). The second through hole (38*b*) corresponds to a through hole of the present disclosure.

A gas-side cover member (155) is attached to the gas-side collecting pipe (152). The gas-side cover member (155) is a cylindrical member made of foamed resin. The gas-side cover member (155) covers a portion of the gas-side collecting pipe (152) extending from the inside to the outside of the casing body (36), and closes a clearance between an edge portion of the through hole formed in the side panel (36*b*) and the gas-side collecting pipe (152).

<Flow of Air in Indoor Unit>

The indoor fan (50) rotates during the operation of the indoor unit (30). When the indoor fan (50) rotates, indoor air in the indoor space flows into the primary space (37*a*) in the casing (35) through the inlet (41). The air flowing in the primary space (37*a*) is sucked by the indoor fan (50) and discharged into the secondary space (37*b*).

The air flowing into the secondary space (37*b*) is cooled or heated while passing through the indoor heat exchanger (65), and then flows separately into the four main outlet paths (57) and the four auxiliary outlet paths (58). The air flowing into the main outlet paths (57) is discharged to the indoor space through the main outlet openings (42). The air flowing into the auxiliary outlet paths (58) is discharged to the indoor space through the auxiliary outlet openings (43).

—Liquid-Side Collecting Pipe—

Figure 6:
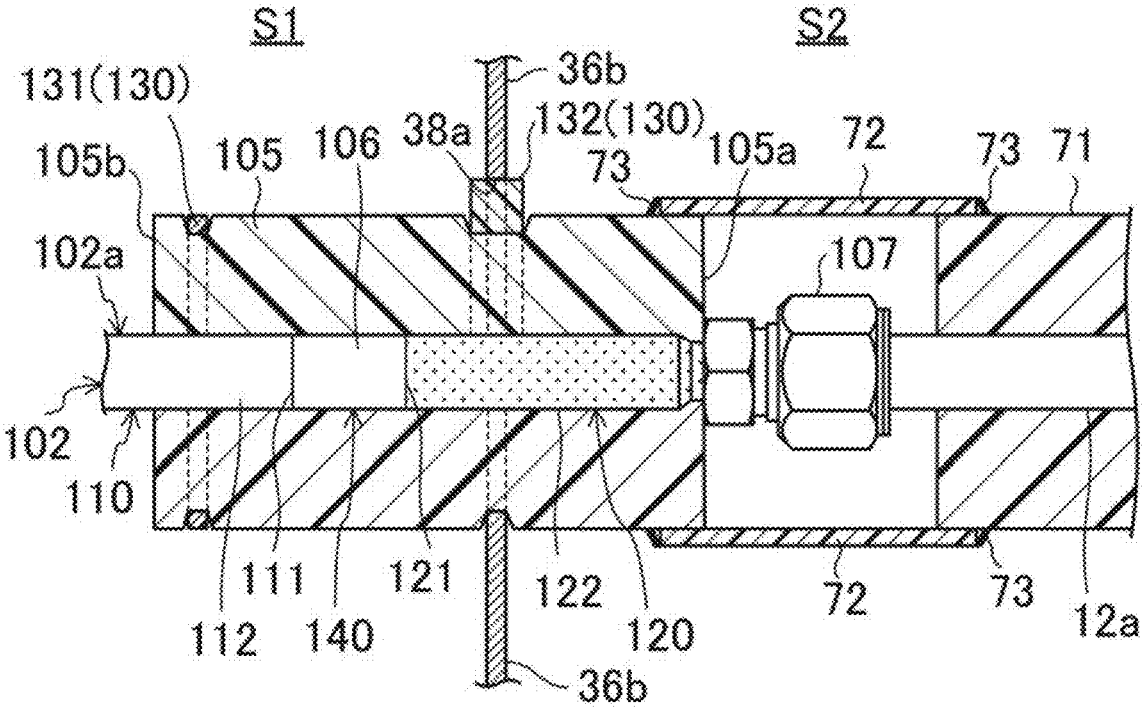
FIG. 6 is a sectional view illustrating the periphery of a liquid-side cover member.

The liquid-side collecting pipe (102) is a refrigerant pipe through which refrigerant in a gas-liquid two-phase state or a liquid single-phase refrigerant flows during the operation of the outdoor unit. As illustrated in FIG. 6, the liquid-side collecting pipe (102) has a liquid-side laterally-extending pipe portion (102*a*) at an end portion opposite to the liquid-side flow divider (101). FIG. 6 does not show the cross-section of the liquid-side collecting pipe (102), a flare joint (107), and a liquid-side connection pipe (12*a*) for the sake of easy understanding of the drawing.

The liquid-side collecting pipe (102) includes a liquid-side first pipe (110), a liquid-side second pipe (120), and a joint pipe (106). The liquid-side laterally-extending pipe portion (102*a*) includes part of the liquid-side first pipe (110) (first horizontal pipe portion (112) described later), the joint pipe (106), and the entirety of the liquid-side second pipe (120) (second horizontal pipe portion (122) described later).

<Liquid-Side Laterally-Extending Pipe Portion>

The center axis direction (extension direction) of the liquid-side laterally-extending pipe portion (102*a*) is substantially horizontal. The liquid-side laterally-extending pipe portion (102*a*) passes through the first through hole (38*a*) of the casing (35). The liquid-side laterally-extending pipe portion (102*a*) is disposed so as to extend across the internal space (S1) and an external space (S2) of the casing (35). The liquid-side laterally-extending pipe portion (102*a*) is covered with the liquid-side cover member (105). A portion of the liquid-side collecting pipe (102) closer to the liquid-side flow divider (101) with respect to the liquid-side laterally-extending pipe portion (102*a*) may be straight or may be curved.

The flare joint (107) is attached to one end (right end in FIG. 6) of the liquid-side laterally-extending pipe portion (102*a*). The material of the flare joint (107) is brass. The flare joint (107) is disposed in the external space (S2) of the casing (35).

The liquid-side connection pipe (12*a*) is inserted into one end of the flare joint (107). The liquid-side connection pipe (12*a*) is connected to the liquid-side shutoff valve (26). The liquid-side connection pipe (12*a*) is covered with a heat insulator (71). The heat insulator (71) is a cylindrical member made of foamed resin.

The liquid-side cover member (105) and the heat insulator (71) are coupled to each other through a coupling member (72). Specifically, both end portions of the coupling member (72) are wrapped with tape members (73), and in this manner, the coupling member (72) is fixed to the liquid-side cover member (105) and the heat insulator (71).

<Liquid-Side First Pipe>

The liquid-side first pipe (110) is a circular pipe. The material of the liquid-side first pipe (110) is aluminum or aluminum alloy. One end of the liquid-side first pipe (110) is inserted into one end of the liquid-side flow divider (101).

As illustrated in FIG. 6, the liquid-side first pipe (110) includes the first horizontal pipe portion (112). The first horizontal pipe portion (112) is a straight circular tubular portion. The center axis direction (extension direction) of the first horizontal pipe portion (112) is substantially horizontal. The first horizontal pipe portion (112) is formed at one end portion (end portion opposite to the liquid-side flow divider (101)) of the liquid-side first pipe (110). One end (right end in FIG. 6) of the first horizontal pipe portion (112) is a first connection end (111).

<Joint Pipe>

The joint pipe (106) is a relatively-short circular tubular member. The joint pipe (106) is disposed substantially coaxially with the liquid-side first pipe (110). One end (left end in FIG. 6) of the joint pipe (106) is joined by brazing to the first connection end (111) which is one end of the liquid-side first pipe (110).

The joint pipe (106) is a metal pipe. The material of the joint pipe (106) is stainless steel. The main component of stainless steel is iron (Fe). The ionization tendency of iron (Fe) is higher than the ionization tendency of copper (Cu) and lower than the ionization tendency of aluminum (Al).

<Liquid-Side Second Pipe>

The liquid-side second pipe (120) is a straight circular pipe. The material of the liquid-side second pipe (120) is copper or copper alloy. The center axis direction (extension direction) of the liquid-side second pipe (120) is substantially horizontal. The liquid-side second pipe (120) is disposed substantially coaxially with the joint pipe (106).

One end (left end in FIG. 6) of the liquid-side second pipe (120) is a second connection end (121). The entirety of the liquid-side second pipe (120) is the second horizontal pipe portion (122) extending in the horizontal direction and including the second connection end (121). The second connection end (121) is joined by brazing to the other end (right end in FIG. 6) of the joint pipe (106). The second horizontal pipe portion (122), the joint pipe (106), and the first horizontal pipe portion (112) are arranged in a straight line.

<Liquid-Side Cover Member>

The liquid-side cover member (105) is made of foamed resin, and is a thick cylindrical member. The liquid-side cover member (105) covers the entire circumference of the liquid-side laterally-extending pipe portion (102*a*) of the liquid-side collecting pipe (102). The liquid-side cover member (105) prevents exposure of the liquid-side laterally-extending pipe portion (102*a*) to air, and also functions as a heat insulator. The liquid-side cover member (105) covers the liquid-side collecting pipe (102) up to the end opposite to the liquid-side flow divider (101). The liquid-side cover member (105) may cover not only the liquid-side laterally-extending pipe portion (102*a*), but also a portion (specifically, curved portion) of the liquid-side collecting pipe (102) other than the liquid-side laterally-extending pipe portion (102*a*).

The liquid-side cover member (105) is disposed in the first through hole (38*a*) so as to extend across the internal space (S1) and the external space (S2) of the casing (35). The liquid-side cover member (105) has a first end (105*a*) which is one end (right end in FIG. 6) of the liquid-side cover member (105) in the extension direction, and a second end (105*b*) which is the other end (left end in FIG. 6) in the extension direction. The first end (105*a*) is located outside the casing (35). The second end (105*b*) is located inside the casing (35).

A liquid-side fastening member (130) is attached to the outer periphery of the liquid-side cover member (105). The liquid-side fastening member (130) fastens the liquid-side cover member (105) to the liquid-side collecting pipe (102). The liquid-side fastening member (130) has a first fastening member (131) and a second fastening member (132).

The first fastening member (131) is disposed closer to the other end (left end in FIG. 6) of the liquid-side cover member (105) in the extension direction. The first fastening member (131) is disposed inside the casing (35). The first fastening member (131) of this embodiment is a zip tie. The zip tie surrounds the entire circumference of the liquid-side cover member (105). The liquid-side cover member (105) is fastened by adjusting the inner diameter of the zip tie to be smaller than the outer diameter of the liquid-side cover member (105). Thus, no clearance is formed between the first fastening member (131) and the liquid-side cover member (105).

The second fastening member (132) is disposed closer to one end (right end in FIG. 6) of the liquid-side cover member (105) in the extension direction. The second fastening member (132) of this embodiment is a fastening member made of foamed resin. The fastening member as the second fastening member (132) is fitted into the first through hole (38*a*) of the casing (35). The second fastening member (132) is a substantially-rectangular member having a slight thickness, and is formed in a shape in which a lower portion thereof is cut out in a semicircular shape.

The first through hole (38*a*) of the casing (35) is configured such that the second fastening member (132) and the liquid-side collecting pipe (102) are fitted therein. Specifically, an upper portion of the first through hole (38*a*) is formed in a rectangular shape, and a lower portion of the first through hole (38*a*) is formed in a semicircular shape.

When the semicircle formed at the lower portion of the first through hole (38*a*) and the semicircle formed at the lower portion of the second fastening member (132) are combined, a circular hole is formed. The liquid-side collecting pipe (102) is disposed in the circular hole. The diameter of the circular hole is greater than the outer diameter of the liquid-side laterally-extending pipe portion (102*a*) and smaller than the outer diameter of the liquid-side cover member (105). Thus, the liquid-side cover member (105) is fastened by fitting the second fastening member (132) in the first through hole (38*a*) of the casing (35). Thus, no clearance is formed between the second fastening member (132) and the liquid-side cover member (105).

The liquid-side cover member (105) is fastened by the first fastening member (131) and the second fastening member (132) in this manner, whereby formation of the clearance between the liquid-side cover member (105) and the liquid-side collecting pipe (102) can be reduced at each end portion of the liquid-side cover member (105).

<Arrangement of First Connection End and Second Connection End of Liquid-Side Collecting Pipe>

The first connection end (111) of the liquid-side collecting pipe (102) is disposed between the first fastening member (131) and the second fastening member (132). As in the first connection end (111), the second connection end (121) of the liquid-side collecting pipe (102) is also disposed between the first fastening member (131) and the second fastening member (132).

The liquid-side collecting pipe (102) has a liquid-side connection portion (140). The liquid-side connection portion (140) includes the first connection end (111) and the second connection end (121) of the liquid-side collecting pipe (102). As illustrated in FIG. 6, in this embodiment, the liquid-side connection portion (140) includes one end portion (right end portion in FIG. 6) of the liquid-side first pipe (110), the joint pipe (106), and one end portion (left end portion in FIG. 6) of the liquid-side second pipe (120). The liquid-side connection portion (140) corresponds to a first portion of the present disclosure.

The liquid-side connection portion (140) is formed in the liquid-side laterally-extending pipe portion (102*a*). The liquid-side connection portion (140) is disposed between the first fastening member (131) and the second fastening member (132). The liquid-side connection portion (140) is disposed in the internal space (S1) of the casing (35).

—Gas-Side Collecting Pipe—

Figure 7:
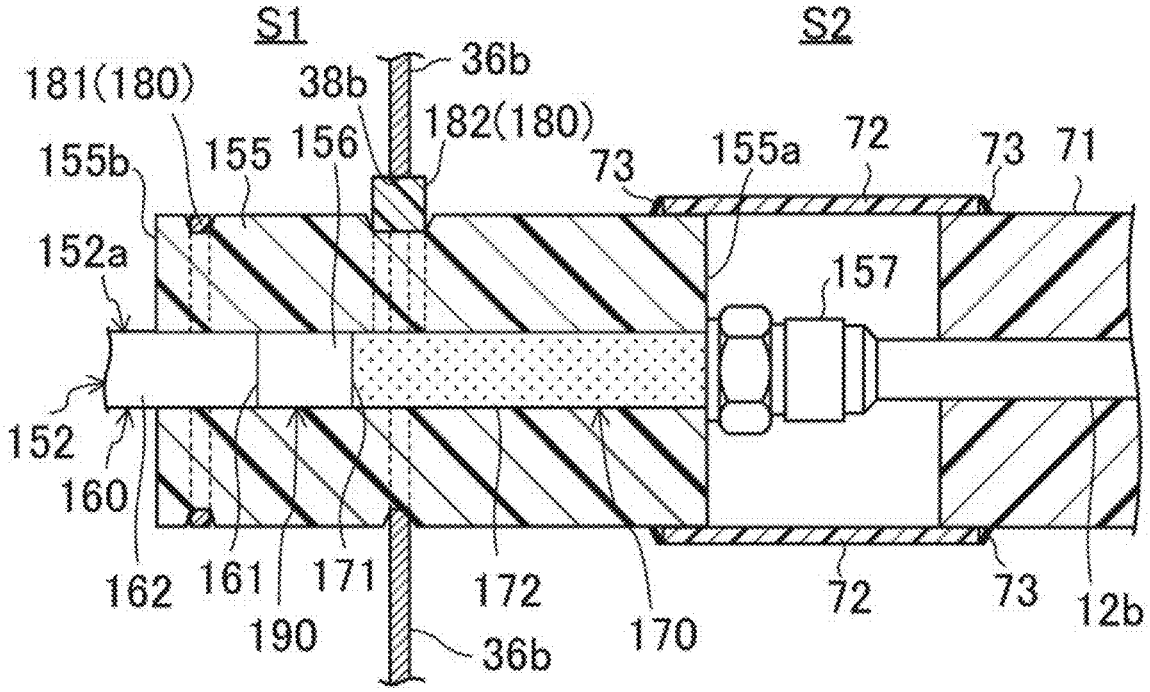
FIG. 7 is a sectional view illustrating the periphery of a gas-side cover member.

The gas-side collecting pipe (152) is a refrigerant pipe through which refrigerant in a gas single-phase state flows during the operation of the outdoor unit. As illustrated in FIG. 7, the gas-side collecting pipe (152) has a gas-side laterally-extending pipe portion (152*a*) at an end portion opposite to the gas-side flow divider (151). In FIG. 7, the gas-side collecting pipe (152), a flare joint (157), and a gas-side connection pipe (12*b*) are not shown in cross section for the sake of easy understanding of the drawing.

The gas-side collecting pipe (152) includes a gas-side first pipe (160), a gas-side second pipe (170), and a joint pipe (156). The gas-side laterally-extending pipe portion (152*a*) includes part of the gas-side first pipe (160) (first horizontal pipe portion (162) described later), the joint pipe (156), and the entirety of the gas-side second pipe (170) (second horizontal pipe portion (172) described later).

<Gas-Side Laterally-Extending Pipe Portion>

The gas-side laterally-extending pipe portion (152*a*) has a configuration similar to that of the liquid-side laterally-extending pipe portion (102*a*). The gas-side laterally-extending pipe portion (152*a*) passes through the second through hole (38*b*) of the casing (35). The gas-side laterally-extending pipe portion (152*a*) is disposed so as to extend across the internal space (S1) and the external space (S2) of the casing (35). The gas-side laterally-extending pipe portion (152*a*) is covered with the gas-side cover member (155).

The flare joint (157) is attached to one end (right end in FIG. 7) of the gas-side laterally-extending pipe portion (152*a*). The material of the flare joint (157) is brass. The flare joint (157) is disposed in the external space (S2) of the casing (35).

The gas-side connection pipe (12*b*) is inserted into one end of the flare joint (157). The gas-side connection pipe (12*b*) is connected to the gas-side shutoff valve (27). The gas-side connection pipe (12*b*) is covered with a heat insulator (71). The configuration of the heat insulator (71) and the connection between the gas-side cover member (155) and the heat insulator (71) are similar to those of the heat insulator (71) for the liquid-side connection pipe (12*a*).

<Gas-Side First Pipe>

The gas-side first pipe (160) and the first horizontal pipe portion (162) have configurations similar to those of the liquid-side first pipe (110) and the first horizontal pipe portion (112). As illustrated in FIG. 7, one end (right end in FIG. 7) of the first horizontal pipe portion (162) is a first connection end (161).

<Joint Pipe>

The joint pipe (156) is a relatively-short circular tubular member. The joint pipe (156) is disposed substantially coaxially with the gas-side first pipe (160). One end (left end in FIG. 7) of the joint pipe (156) is joined by brazing to the first connection end (161) which is one end of the gas-side first pipe (160).

The joint pipe (156) is a metal pipe. The material of the joint pipe (156) is stainless steel. The main component of stainless steel is iron (Fe). The ionization tendency of iron (Fe) is higher than the ionization tendency of copper (Cu) and lower than the ionization tendency of aluminum (Al).

<Gas-Side Second Pipe>

The gas-side second pipe (170) has a configuration similar to that of the liquid-side second pipe (120). One end (left end in FIG. 7) of the gas-side second pipe (170) is a second connection end (171). The entirety of the gas-side second pipe (170) is the second horizontal pipe portion (172) extending in the horizontal direction and including the second connection end (171). The second horizontal pipe portion (172), the joint pipe (156), and the first horizontal pipe portion (162) are arranged in a straight line.

<Gas-Side Cover Member>

The gas-side cover member (155) has a configuration similar to that of the liquid-side cover member (105). The gas-side cover member (155) covers the entire circumference of the gas-side laterally-extending pipe portion (152*a*) of the gas-side collecting pipe (152). The gas-side cover member (155) covers the gas-side collecting pipe (152) up to the end opposite to the gas-side flow divider (151).

The gas-side cover member (155) is disposed in the second through hole (38*b*) so as to extend across the internal space (S1) and the external space (S2) of the casing (35). The gas-side cover member (155) has a first end (155*a*) which is one end (right end in FIG. 7) of the gas-side cover member (155) in the extension direction, and a second end (155*b*) which is the other end (left end in FIG. 7) in the extension direction. The first end (155*a*) is located outside the casing (35). The second end (155*b*) is located inside the casing (35).

A gas-side fastening member (180) is attached to the outer periphery of the gas-side cover member (155). The gas-side fastening member (180) fastens the gas-side cover member (155) to the gas-side collecting pipe (152). The gas-side fastening member (180) has a first fastening member (181) and a second fastening member (182). The first fastening member (181) and the second fastening member (182) have configurations similar to those of the first fastening member (131) and the second fastening member (132).

The first fastening member (181) of this embodiment is a zip tie. The second fastening member (182) of this embodiment is a fastening member made of foamed resin. The fastening member as the second fastening member (182) is fitted into the second through hole (38*b*) of the casing (35). The second fastening member (182) is a substantially-rectangular member having a slight thickness, and is formed in a shape in which a lower portion thereof is cut out in a semicircular shape.

The second through hole (38*b*) of the casing (35) is configured such that the second fastening member (182) and the gas-side collecting pipe (152) are fitted therein. Specifically, an upper portion of the second through hole (38*b*) is formed in a rectangular shape, and a lower portion of the second through hole (38*b*) is formed in a semicircular shape.

When the semicircle formed at the lower portion of the second through hole (38*b*) and the semicircle formed at the lower portion of the second fastening member (182) are combined, a circular hole is formed. The gas-side collecting pipe (152) is disposed in the circular hole. The diameter of the circular hole is greater than the outer diameter of the gas-side laterally-extending pipe portion (152*a*) and smaller than the outer diameter of the gas-side cover member (155). Thus, the liquid-side cover member (155) is fastened by fitting the second fastening member (182) in the second through hole (38*b*) of the casing (35).

The gas-side cover member (155) is fastened by the first fastening member (181) and the second fastening member (182) in this manner, whereby formation of the clearance between the gas-side cover member (155) and the gas-side collecting pipe (152) can be reduced at each end portion of the gas-side cover member (155).

<Arrangement of First Connection End and Second Connection End of Gas-Side Collecting Pipe>

The first connection end (161) of the gas-side collecting pipe (152) is disposed between the first fastening member (181) and the second fastening member (182). As in the first connection end (161), the second connection end (171) of the gas-side collecting pipe (152) is also disposed between the first fastening member (181) and the second fastening member (182).

The gas-side collecting pipe (152) has a gas-side connection portion (190). The gas-side connection portion (190) includes the first connection end (161) and the second connection end (171) of the gas-side collecting pipe (152). As illustrated in FIG. 7, in this embodiment, the gas-side connection portion (190) includes one end portion (right end portion in FIG. 7) of the gas-side first pipe (160), the joint pipe (156), and one end portion (left end portion in FIG. 7) of the gas-side second pipe (170). The gas-side connection portion (190) corresponds to a first portion of the present disclosure.

The gas-side connection portion (190) is formed in the gas-side laterally-extending pipe portion (152*a*). The gas-side connection portion (190) is disposed between the first fastening member (181) and the second fastening member (182). The gas-side connection portion (190) is disposed in the internal space (S1) of the casing (35).

Feature (1) of Embodiment

The liquid-side collecting pipe (102) of this embodiment includes the liquid-side first pipe (110) made of aluminum or aluminum alloy and the liquid-side second pipe (120) made of copper or copper alloy. The first connection end (111) of the liquid-side first pipe (110) and the second connection end (121) of the liquid-side second pipe (120) are connected to each other through the joint pipe (106). The liquid-side collecting pipe (102) includes the liquid-side connection portion (140) having the first connection end (111) of the liquid-side first pipe (110), the second connection end (121) of the liquid-side second pipe (120), and the joint pipe (106). The entire circumference of the liquid-side connection portion (140) is covered with the liquid-side cover member (105). The liquid-side cover member (105) is disposed in the first through hole (38*a*) of the casing (35) so as to extend across the internal space (S1) and the external space (S2) of the casing (35).

The liquid-side connection portion (140) is preferably formed in a straight line from the viewpoint of workability when the liquid-side first pipe (110), the joint pipe (106), and the liquid-side second pipe (120) are joined to each other. On the other hand, the casing (35) houses components such as the indoor fan (50) and the indoor heat exchanger (65), and therefore, has an extremely-small piping space for the liquid-side collecting pipe (102). In a case where the liquid-side connection portion (140) is disposed in the limited piping space, the liquid-side connection portion (140) may be disposed in the vicinity of the first through hole (38*a*) of the casing (35). This is because the vicinity of the first through hole (38*a*) of the casing (35) has some room for the installation work of the indoor unit (30).

The internal space (S1) and the external space (S2) of the casing (35) are significantly different in temperature and humidity. The first through hole (38*a*) is located at the boundary between the internal space (S1) and the external space (S2) of the casing (35). Thus, in a case where the liquid-side connection portion (140) is disposed in the vicinity of the first through hole (38*a*), condensate water (dew water) is likely to be generated on the liquid-side connection portion (140).

In this embodiment, the entire circumference of the liquid-side connection portion (140) is covered with the liquid-side cover member (105), and therefore, the liquid-side connection portion (140) is not exposed to air. This can reduce generation of condensate water on the surface of the liquid-side connection portion (140). Thus, condensate water containing copper ions is less likely to adhere to the liquid-side first pipe (110). As a result, corrosion of the liquid-side first pipe (110) can be reduced.

Feature (2) of Embodiment

The liquid-side cover member (105) of this embodiment is fastened by the first fastening member (131) and the second fastening member (132). The first connection end (111) of the liquid-side first pipe (110) and the second connection end (121) of the liquid-side second pipe (120) are disposed between the first fastening member (131) and the second fastening member (132).

With this configuration, the liquid-side cover member (105) is fastened by the first fastening member (131), and therefore, no clearance is formed between the liquid-side cover member (105) and the liquid-side collecting pipe (102). Thus, even if condensate water is generated on the surface of the liquid-side collecting pipe (102) closer to the liquid-side flow divider (101) with respect to the first fastening member (131), the condensate water flowing along the liquid-side collecting pipe (102) does not enter between the liquid-side cover member (105) and the liquid-side collecting pipe (102), and therefore, corrosion of the liquid-side first pipe (110) due to adhesion of condensate water containing copper ions can be reduced.

The liquid-side cover member (105) is fastened by the second fastening member (132), and therefore, no clearance is formed between the liquid-side cover member (105) and the liquid-side collecting pipe (102). Thus, even if condensate water is generated on the surface of the liquid-side collecting pipe (102) disposed outside the casing (35), the condensate water flowing along the liquid-side collecting pipe (102) disposed outside the casing (35) does not enter between the liquid-side cover member (105) and the liquid-side collecting pipe (102), and therefore, corrosion of the liquid-side first pipe (110) due to adhesion of condensate water containing copper ions can be reduced.

Since the liquid-side cover member (105) is fastened on both sides thereof in this manner, condensate water generated on the liquid-side collecting pipe (102) located inside and outside the casing (35) does not enter between the liquid-side cover member (105) and the liquid-side collecting pipe (102). This can more reliably reduce corrosion of the liquid-side first pipe (110) due to adhesion of condensate water containing copper ions.

Feature (3) of Embodiment

The liquid-side connection portion (140) of this embodiment is disposed in the liquid-side laterally-extending pipe portion (102*a*), which extends horizontally, of the liquid-side collecting pipe (102), and therefore, extends horizontally. Thus, the first horizontal pipe portion (112) of the liquid-side first pipe (110) is not located lower than the second horizontal pipe portion (122) of the liquid-side second pipe (120), and therefore, even if condensate water containing copper ions is generated on the liquid-side second pipe (120), the condensate water is less likely to adhere to the liquid-side first pipe (110). Consequently, corrosion of the liquid-side first pipe (110) can be reduced.

Feature (4) of Embodiment

The gas-side collecting pipe (152) of this embodiment has the gas-side first pipe (160) made of aluminum or aluminum alloy and the gas-side second pipe (170) made of copper or copper alloy. The first connection end (161) of the gas-side first pipe (160) and the second connection end (171) of the gas-side second pipe (170) are connected to each other through the joint pipe (156). The gas-side collecting pipe (152) includes the gas-side connection portion (190) having the first connection end (161) of the gas-side first pipe (160), the second connection end (171) of the gas-side second pipe (170), and the joint pipe (156). The entire circumference of the gas-side connection portion (190) is covered with the gas-side cover member (155). The gas-side cover member (155) is disposed in the second through hole (38*b*) of the casing (35) so as to extend across the internal space (S1) and the external space (S2) of the casing (35).

The gas-side connection portion (190) is preferably formed in a straight line from the viewpoint of workability when the gas-side first pipe (160), the joint pipe (156), and the gas-side second pipe (170) are joined to each other. On the other hand, the casing (35) houses components such as the indoor fan (50) and the indoor heat exchanger (65), and therefore, has an extremely-small piping space for the gas-side collecting pipe (152). In a case where the gas-side connection portion (190) is disposed in the limited piping space, the gas-side connection portion (190) may be disposed in the vicinity of the second through hole (38*b*) of the casing (35). This is because the vicinity of the second through hole (38*b*) of the casing (35) has some room for the installation work of the indoor unit (30).

The internal space (S1) and the external space (S2) of the casing (35) are significantly different in temperature and humidity. The second through hole (38*b*) is located at the boundary between the internal space (S1) and the external space (S2) of the casing (35). Thus, in a case where the gas-side connection portion (190) is disposed in the vicinity of the second through hole (38*b*), condensate water (dew water) is likely to be generated on the gas-side connection portion (190).

In this embodiment, the entire circumference of the gas-side connection portion (190) is covered with the gas-side cover member (155), and therefore, the gas-side connection portion (190) is not exposed to air. This can reduce generation of condensate water on the surface of the gas-side connection portion (190). Thus, condensate water containing copper ions is less likely to adhere to the gas-side first pipe (160). As a result, corrosion of the gas-side first pipe (160) can be reduced.

Feature (5) of Embodiment

The gas-side cover member (155) of this embodiment is fastened by the first fastening member (181) and the second fastening member (182). The first connection end (161) of the gas-side first pipe (160) and the second connection end (171) of the gas-side second pipe (170) are disposed between the first fastening member (181) and the second fastening member (182).

With this configuration, the gas-side cover member (155) is fastened by the first fastening member (181), and therefore, no clearance is formed between the gas-side cover member (155) and the gas-side collecting pipe (152). Thus, even if condensate water is generated on the surface of the gas-side collecting pipe (152) disposed inside the casing (35), the condensate water flowing along the gas-side collecting pipe (152) disposed inside the casing (35) does not enter between the gas-side cover member (155) and the gas-side collecting pipe (152), and therefore, corrosion of the gas-side first pipe (160) due to adhesion of condensate water containing copper ions can be reduced.

Moreover, the gas-side cover member (155) is fastened by the second fastening member (182), and therefore, no clearance is formed between the gas-side cover member (155) and the gas-side collecting pipe (152). Thus, even if condensate water is generated on the surface of the gas-side collecting pipe (152) disposed outside the casing (35), the condensate water flowing along the gas-side collecting pipe (152) disposed outside the casing (35) does not enter between the gas-side cover member (155) and the gas-side collecting pipe (152), and therefore, corrosion of the gas-side first pipe (160) due to adhesion of condensate water containing copper ions can be reduced.

Since the gas-side cover member (155) is fastened on both sides thereof in this manner, condensate water generated on the gas-side collecting pipe (152) located inside and outside the casing (35) does not enter between the gas-side cover member (155) and the gas-side collecting pipe (152). This can more reliably reduce corrosion of the gas-side first pipe (160) due to adhesion of condensate water containing copper ions.

Feature (6) of Embodiment

The gas-side connection portion (190) of this embodiment is disposed in the gas-side laterally-extending pipe portion (152*a*), which extends horizontally, of the gas-side collecting pipe (152), and therefore, extends horizontally. Thus, the first horizontal pipe portion (162) of the gas-side first pipe (160) is not located lower than the second horizontal pipe portion (172) of the gas-side second pipe (170). In a case where condensate water is generated on the surface of the gas-side collecting pipe (152) located inside and outside the casing (35) and enters between the gas-side connection portion (190) and the gas-side cover member (155) along the gas-side collecting pipe (152), even if condensate water containing copper ions generated on the gas-side second pipe (170), the condensate water flows down by gravitation and is less likely to adhere to the liquid-side first pipe (110). Consequently, corrosion of the liquid-side first pipe (110) can be reduced.

First Variation of Embodiment

Figure 8:
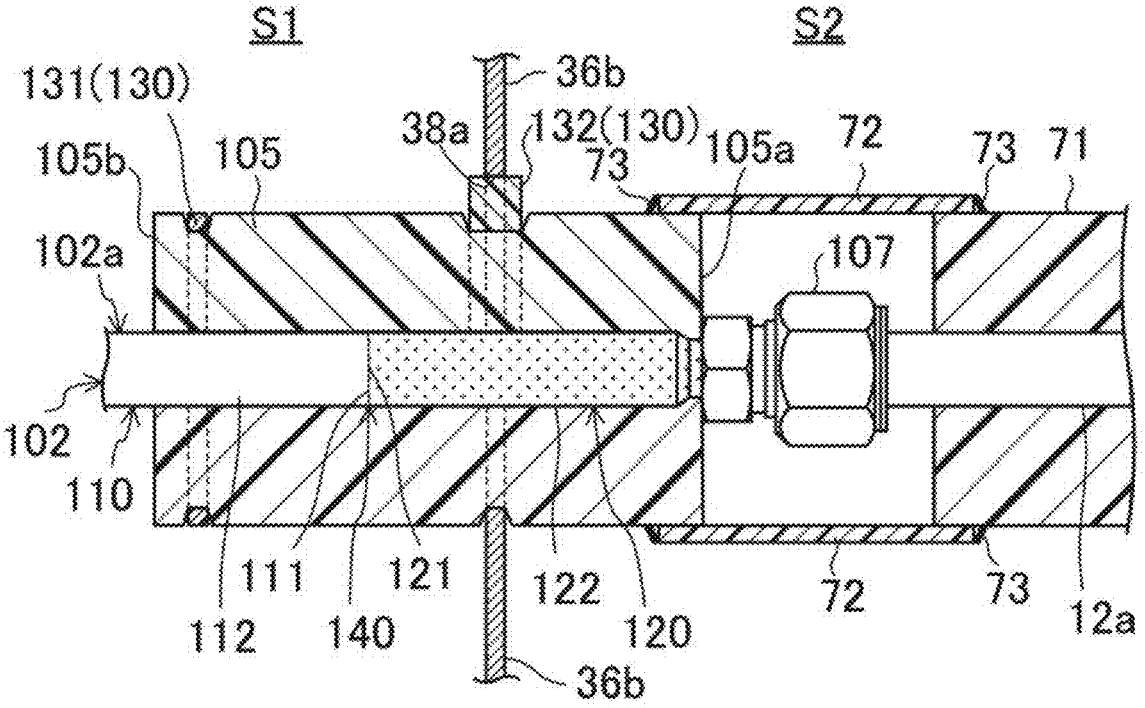
FIG. 8 is a view of a first variation, which corresponds to FIG. 6.

As illustrated in FIG. 8, in the liquid-side collecting pipe (102) of this embodiment, the first connection end (111) of the liquid-side first pipe (110) and the second connection end (121) of the liquid-side second pipe (120) may be directly joined to each other. In this case, the joint pipe (106) is omitted from the liquid-side collecting pipe (102).

In the gas-side collecting pipe (152) of this embodiment, the first connection end (161) of the gas-side first pipe (160) and the second connection end (171) of the gas-side second pipe (170) may be directly joined to each other. In this case, the joint pipe (156) is omitted from the gas-side collecting pipe (152).

Second Variation of Embodiment

Figure 9:
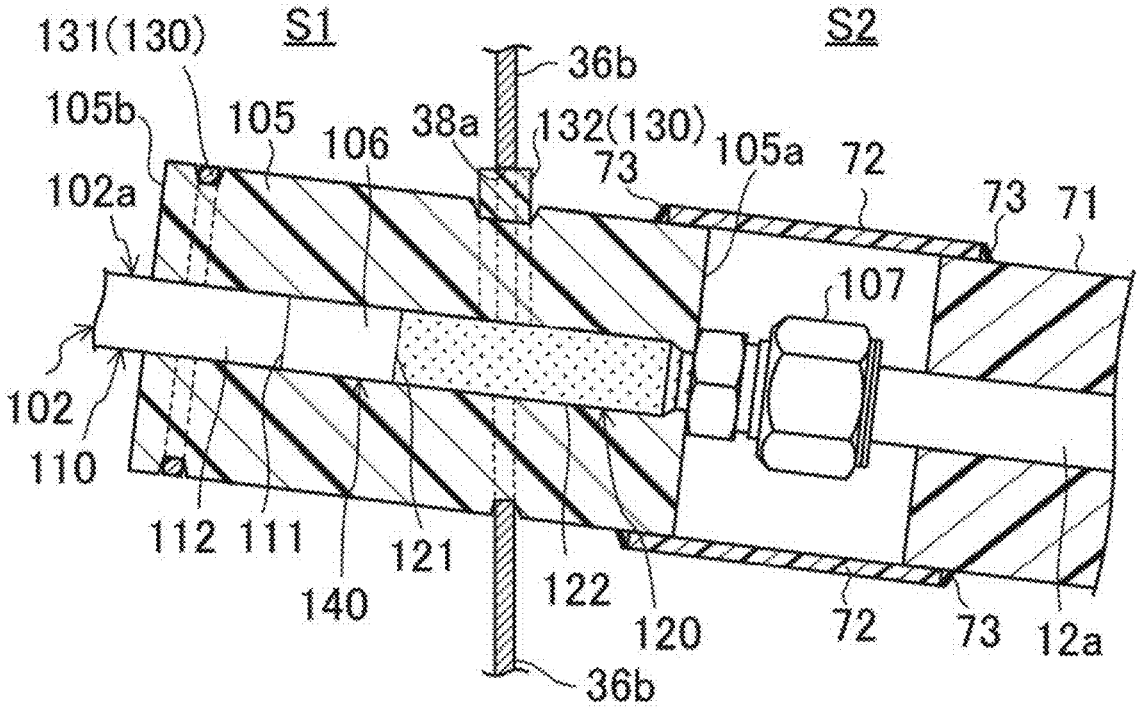
FIG. 9 is a view of a second variation, which corresponds to FIG. 6.

As illustrated in FIG. 9, in the liquid-side collecting pipe (102) of this embodiment, the liquid-side laterally-extending pipe portion (102*a*) may be inclined downward toward the outside of the casing (35). Also in this case, the first horizontal pipe portion (112) of the liquid-side first pipe (110) is not located lower than the second horizontal pipe portion (122) of the liquid-side second pipe (120). Thus, even if condensate water containing copper ions is generated on the liquid-side second pipe (120), the condensate water flows down by gravitation and is less likely to adhere to the liquid-side first pipe (110). Consequently, corrosion of the liquid-side first pipe (110) can be reduced.

Third Variation of Embodiment

Figure 10:
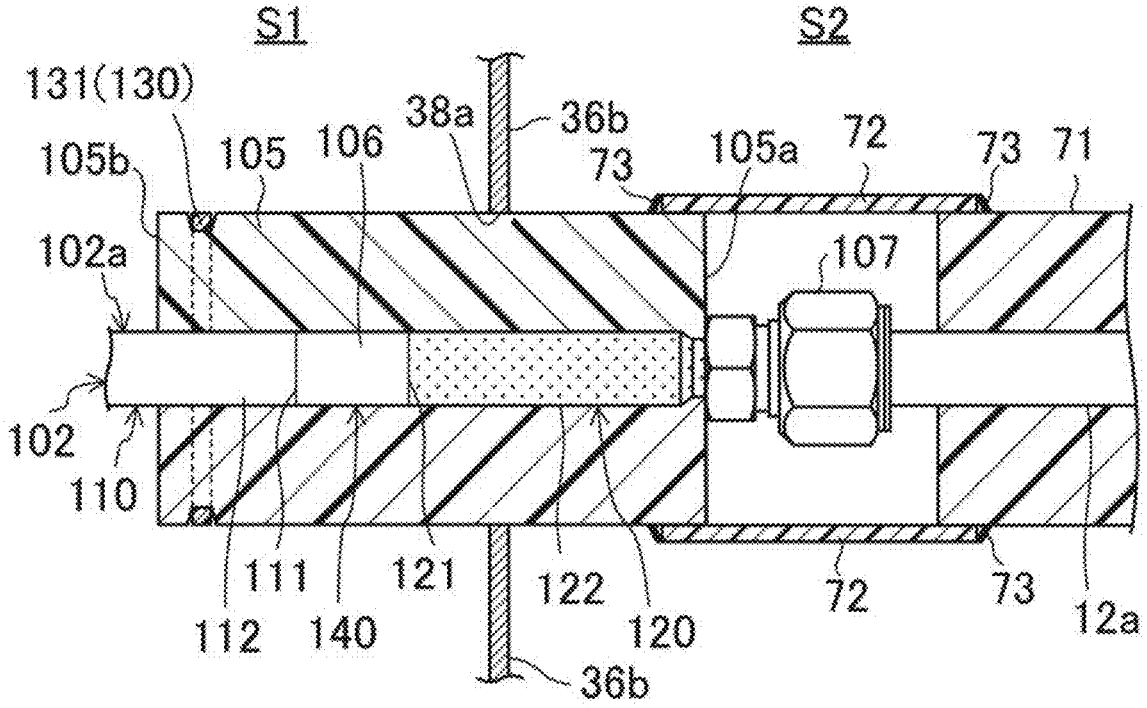
FIG. 10 is a view of a third variation, which corresponds to FIG. 6.

As illustrated in FIG. 10, the liquid-side fastening member (130) attached to the liquid-side cover member (105) of this embodiment may have only the first fastening member (131). In this case, the second fastening member (132) is not disposed in the first through hole (38*a*) of the casing (35). The diameter of the first through hole (38*a*) is substantially equal to the outer diameter of the liquid-side cover member (105). Thus, the liquid-side cover member (105) is not fastened by the casing (35).

In this case, the first connection end (111) of the first horizontal pipe portion (112) is disposed between the first fastening member (131) and the first end (105*a*) of the liquid-side cover member (105) located outside the casing (35). Also in this case, the liquid-side cover member (105) is fastened by the first fastening member (131), and therefore, no clearance is formed between the liquid-side cover member (105) and the liquid-side collecting pipe (102). Thus, even if condensate water is generated on the surface of the liquid-side collecting pipe (102) closer to the liquid-side flow divider (101) with respect to the first fastening member (131), the condensate water flowing along the liquid-side collecting pipe (102) does not enter between the liquid-side cover member (105) and the liquid-side collecting pipe (102), and therefore, corrosion of the liquid-side first pipe (110) due to adhesion of condensate water containing copper ions can be reduced.

The gas-side fastening member (180) attached to the gas-side cover member (155) of this embodiment may have only the first fastening member (181). In this case, the second fastening member (182) is not disposed in the second through hole (38*b*) of the casing (35). The diameter of the second through hole (38*b*) is substantially equal to the outer diameter of the gas-side cover member (155). Thus, the gas-side cover member (155) is not fastened by the casing (35).

In this case, the first connection end (161) of the first horizontal pipe portion (162) is disposed between the first fastening member (181) and the first end (155*a*) of the gas-side cover member (155) located outside the casing (35). Also in this case, the gas-side cover member (155) is fastened by the first fastening member (181), and therefore, no clearance is formed between the gas-side cover member (155) and the gas-side collecting pipe (152). Thus, even if condensate water is generated on the surface of the gas-side collecting pipe (152) closer to the gas-side flow divider (151) with respect to the first fastening member (181), the condensate water flowing along the gas-side collecting pipe (152) does not enter between the gas-side cover member (155) and the gas-side collecting pipe (152), and therefore, corrosion of the gas-side first pipe (160) due to adhesion of condensate water containing copper ions can be reduced.

Fourth Variation of Embodiment

Figure 11:
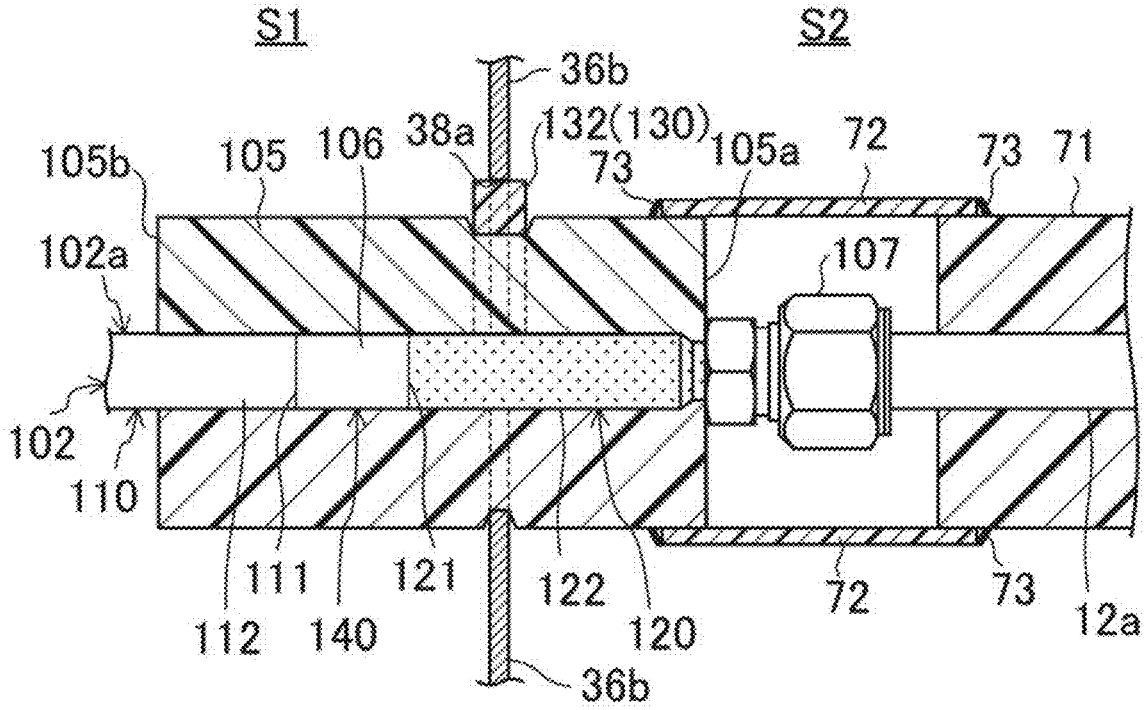
FIG. 11 is a view of a fourth variation, which corresponds to FIG. 6.

As illustrated in FIG. 11, the liquid-side fastening member (130) attached to the liquid-side cover member (105) of this embodiment may have only the second fastening member (132). In this case, the zip tie as the first fastening member (131) is omitted.

In this case, the second connection end (121) of the second horizontal pipe portion (122) is disposed between the second fastening member (132) and the second end (105*b*) of the liquid-side cover member (105) located inside the casing (35). Also in this case, the liquid-side cover member (105) is fastened by the second fastening member (132), and therefore, no clearance is formed between the liquid-side cover member (105) and the liquid-side collecting pipe (102). Thus, even if condensate water is generated on the surface of the liquid-side collecting pipe (102) disposed outside the casing (35), the condensate water flowing along the liquid-side collecting pipe (102) disposed outside the casing (35) does not enter between the liquid-side cover member (105) and the liquid-side collecting pipe (102), and therefore, corrosion of the liquid-side first pipe (110) due to adhesion of condensate water containing copper ions can be reduced.

The gas-side fastening member (180) attached to the gas-side cover member (155) of this embodiment may have only the second fastening member (182). In this case, the zip tie as the first fastening member (131) is omitted.

In this case, the second connection end (171) of the second horizontal pipe portion (172) is disposed between the second fastening member (182) and the second end (155*b*) of the gas-side cover member (155) located inside the casing (35). Also in this case, the gas-side cover member (155) is fastened by the second fastening member (182), and therefore, no clearance is formed between the gas-side cover member (155) and the gas-side collecting pipe (152). Thus, even if condensate water is generated on the surface of the gas-side collecting pipe (152) disposed inside the casing (35), the condensate water flowing along the gas-side collecting pipe (152) disposed inside the casing (35) does not enter between the gas-side cover member (155) and the gas-side collecting pipe (152), and therefore, corrosion of the gas-side first pipe (160) due to adhesion of condensate water containing copper ions can be reduced.

Fifth Variation of Embodiment

Figure 12:
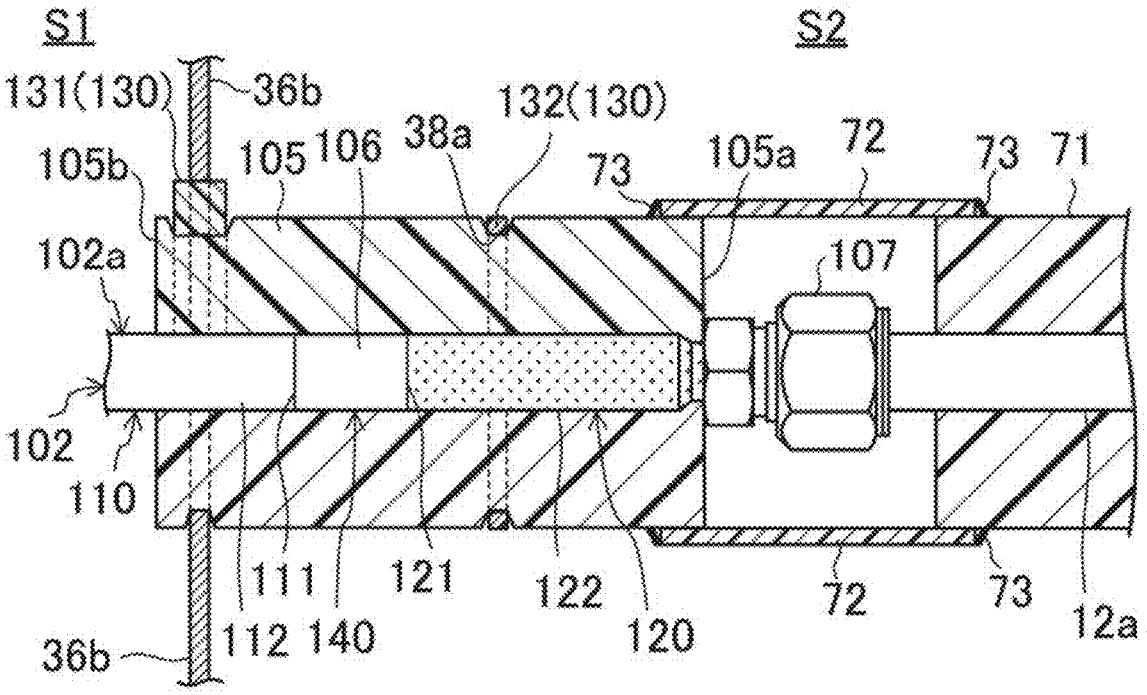
FIG. 12 is a view of a fifth variation, which corresponds to FIG. 6.

As illustrated in FIG. 12, the first fastening member (131) attached to the liquid-side cover member (105) of this embodiment may be a fastening member disposed in the first through hole (38*a*) of the casing (35). In this case, the second fastening member (132) is a zip tie, and is disposed outside the casing (35). Moreover, in this case, the liquid-side connection portion (140) is disposed in the vicinity of the first through hole (38*a*) outside the casing (35). Also in this case, it is possible to obtain effects similar to those of the above-described embodiment.

The first fastening member (181) attached to the gas-side cover member (155) of this embodiment may be a fastening member disposed in the second through hole (38*b*) of the casing (35). In this case, the second fastening member (182) is a zip tie, and is disposed outside the casing (35). Moreover, in this case, the gas-side connection portion (190) is disposed in the vicinity of the second through hole (38*b*) outside the casing (35). Also in this case, it is possible to obtain effects similar to those of the above-described embodiment.

Sixth Variation of Embodiment

The casing (35) of this embodiment includes the first through hole (38*a*) through which the liquid-side collecting pipe (102) passes and the second through hole (38*b*) through which the gas-side collecting pipe (152) passes. Alternatively, the casing (35) may include a through hole through which the liquid-side collecting pipe (102) and the gas-side collecting pipe (152) pass. In this case, one fastening member is configured to have the functions of the liquid-side second fastening member (132) and the gas-side second fastening member (182), and is fitted in the one through hole.

Seventh Variation of Embodiment

The second fastening member (132, 182) of this embodiment may be a zip tie. In this case, the second fastening member (132, 182) is disposed in the vicinity of the through hole (38*a*, 38*b*) of the casing (35). In this case, the zip tie as the second fastening member (132, 182) may be disposed inside the casing (35) or outside the casing (35).

Eighth Variation of Embodiment

Figure 13:
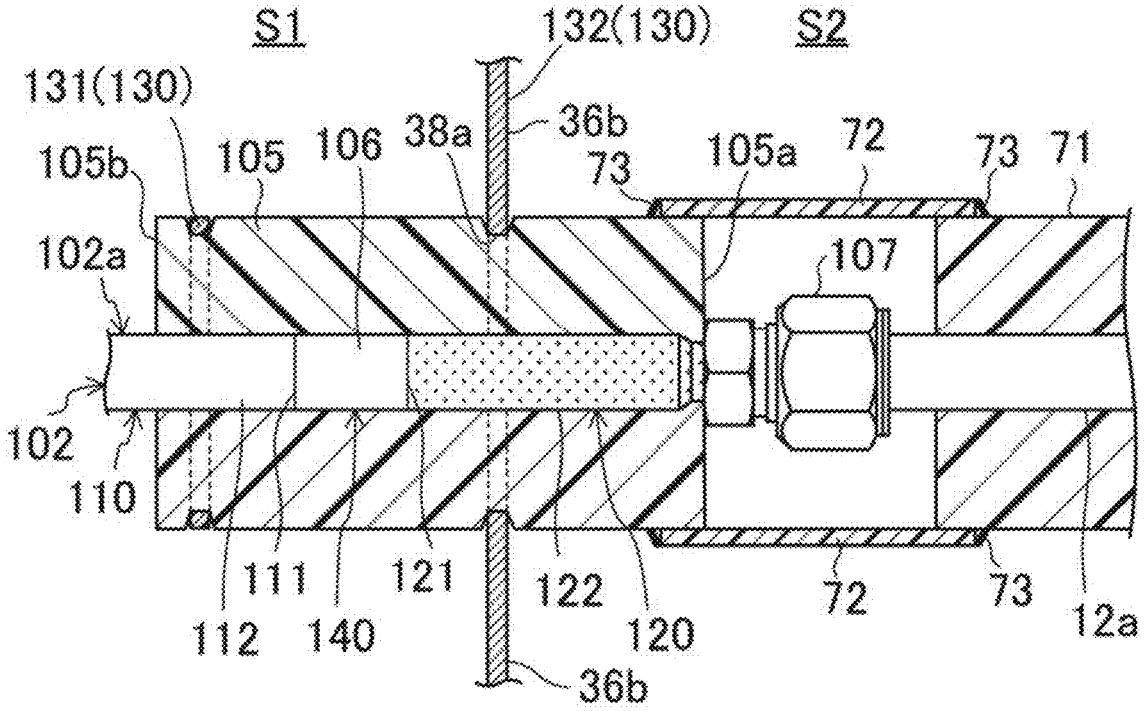
FIG. 13 is a view of an eighth variation, which corresponds to FIG. 6.

As illustrated in FIG. 13, the second fastening member (132) attached to the liquid-side cover member (105) of this embodiment may be the casing (35). In this case, the diameter of the first through hole (38*a*) of the casing (35) is larger than the outer diameter of the liquid-side laterally-extending pipe portion (102*a*) and smaller than the outer diameter of the liquid-side cover member (105). Thus, the liquid-side cover member (105) is fastened by the first through hole (38*a*) of the casing (35). Consequently, no clearance is formed between the second fastening member (132) and the liquid-side cover member (105). Also in this case, it is possible to obtain effects similar to those of the above-described embodiment.

The second fastening member (182) attached to the gas-side cover member (155) of this embodiment may be the casing (35). In this case, the diameter of the second through hole (38*b*) of the casing (35) is larger than the outer diameter of the gas-side laterally-extending pipe portion (152*a*) and smaller than the outer diameter of the gas-side cover member (155). Thus, the gas-side cover member (155) is fastened by the second through hole (38*b*) of the casing (35). Consequently, no clearance is formed between the second fastening member (182) and the gas-side cover member (155). Also in this case, it is possible to obtain effects similar to those of the above-described embodiment.

Ninth Variation of Embodiment

The liquid-side cover member (105) of this embodiment is not necessarily fastened to the liquid-side collecting pipe (102) by the liquid-side fastening member (130). In other words, the indoor unit (30) does not necessarily include the liquid-side fastening member (130).

The gas-side cover member (155) of this embodiment is not necessarily fastened to the gas-side collecting pipe (152) by the gas-side fastening member (180). In other words, the indoor unit (30) does not necessarily include the gas-side fastening member (180).

Tenth Variation of Embodiment

One or both of the liquid pipe unit (100) or the gas pipe unit (150) of this embodiment may be connected to a heat transfer tube of the outdoor heat exchanger (23) provided in the outdoor unit (20) as the constituent unit.

While the embodiment and variations thereof have been described above, it will be understood that various changes in form and details may be made without departing from the spirit and scope of the claims. The elements according to embodiments, the variations thereof, and the other embodiments may be combined and replaced with each other.

The ordinal numbers such as "first," "second," "third," . . . , described above are used to distinguish the terms to which these expressions are given, and do not limit the number and order of the terms.

INDUSTRIAL APPLICABILITY

As described above, the present disclosure is useful for an air conditioner constituent unit and an air conditioner.

DESCRIPTION OF REFERENCE CHARACTERS

10 Air Conditioner
20 Outdoor Unit (Constituent Unit)
30 Indoor Unit (Constituent Unit)
35 Casing
38*a* First Through Hole (Through Hole)
38*b* Second Through Hole (Through Hole)
65 Indoor Heat Exchanger (Heat Exchanger)
66 Heat Transfer Tube
101 Liquid-Side Flow Divider (Flow Divider)
102 Liquid-Side Collecting Pipe (Refrigerant Pipe)
102*a* Liquid-Side Laterally-Extending Pipe Portion (Laterally-Extending Pipe Portion)
105 Liquid-Side Cover Member (Cover Member)
105*a* First End
105*b* Second End
106 Joint Pipe (Metal Pipe)
110 Liquid-Side First Pipe (First Pipe)
111 First Connection End
120 Liquid-Side Second Pipe (Second Pipe)
121 Second Connection End
131 First Fastening Member
132 Second Fastening Member
140 Liquid-Side Connection Portion (First Portion)
151 Gas-Side Flow Divider (Flow Divider)
152 Gas-Side Collecting Pipe (Refrigerant Pipe)
152*a* Gas-Side Laterally-Extending Pipe Portion (Laterally-Extending Pipe Portion)
155 Gas-Side Cover Member (Cover Member)
155*a* First End
155*b* Second End
156 Joint Pipe (Metal Pipe)
160 Gas-Side First Pipe (First Pipe)
161 First Connection End
170 Gas-Side Second Pipe (Second Pipe)

171 Second Connection End
181 First Fastening Member
182 Second Fastening Member
190 Gas-Side Connection Portion (First Portion)
S1 Internal Space
S2 External Space

The invention claimed is:

1. An air conditioner constituent unit comprising:
a casing having a through hole;
a heat exchanger that is housed in the casing and has a plurality of heat transfer tubes;
a refrigerant pipe passing through the through hole;
a flow divider that is connected to the heat exchanger and the refrigerant pipe and distributes refrigerant flowing in from the refrigerant pipe to the plurality of heat transfer tubes; and
a cover member covering the refrigerant pipe,
the refrigerant pipe having
a first pipe connected to the flow divider and made of aluminum or aluminum alloy, and
a second pipe made of copper or copper alloy,
a first connection end of the first pipe and a second connection end of the second pipe being directly connected or connected through a metal pipe made of a material different from those of the first pipe and the second pipe,
the cover member being disposed in the through hole to extend across an internal space and an external space of the casing,
a first portion of the refrigerant pipe including the first connection end of the first pipe and the second connection end of the second pipe being covered with the cover member.

2. The air conditioner constituent unit of claim 1, further comprising:
a fastening member fastening the cover member to the refrigerant pipe,
wherein the first connection end is disposed between a first end of the cover member located outside the casing and the fastening member.

3. The air conditioner constituent unit of claim 1, further comprising:
a fastening member fastening the cover member to the refrigerant pipe, wherein
the second connection end is disposed between a second end of the cover member located inside the casing and the fastening member.

4. The air conditioner constituent unit of claim 1, further comprising:
a first fastening member and a second fastening member fastening the cover member to the refrigerant pipe, wherein
the first connection end and the second connection end are disposed between the first fastening member and the second fastening member.

5. The air conditioner constituent unit of claim 1, wherein
the refrigerant pipe includes a laterally-extending pipe portion that extends horizontally or is inclined downward toward the outside of the casing, and
the first portion of the refrigerant pipe is disposed in the laterally-extending pipe portion.

6. An air conditioner comprising: the constituent unit of claim 1.

7. The air conditioner constituent unit of claim 2, wherein
the refrigerant pipe includes a laterally-extending pipe portion that extends horizontally or is inclined downward toward the outside of the casing, and
the first portion of the refrigerant pipe is disposed in the laterally-extending pipe portion.

8. The air conditioner constituent unit of claim 3, wherein
the refrigerant pipe includes a laterally-extending pipe portion that extends horizontally or is inclined downward toward the outside of the casing, and
the first portion of the refrigerant pipe is disposed in the laterally-extending pipe portion.

9. The air conditioner constituent unit of claim 4, wherein
the refrigerant pipe includes a laterally-extending pipe portion that extends horizontally or is inclined downward toward the outside of the casing, and
the first portion of the refrigerant pipe is disposed in the laterally-extending pipe portion.

10. An air conditioner comprising: the constituent unit of claim 2.

11. An air conditioner comprising: the constituent unit of claim 3.

12. An air conditioner comprising: the constituent unit of claim 4.

13. An air conditioner comprising: the constituent unit of claim 5.

* * * * *